US010731375B2

(12) United States Patent
Reddy et al.

(10) Patent No.: US 10,731,375 B2
(45) Date of Patent: Aug. 4, 2020

(54) SIDE SADDLE SLINGSHOT DRILLING RIG

(71) Applicant: Nabors Drilling Technologies USA, Inc., Houston, TX (US)

(72) Inventors: Padira Reddy, Richmond, TX (US); Ashish Gupta, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 0 days.

(21) Appl. No.: 16/246,472

(22) Filed: Jan. 12, 2019

(65) Prior Publication Data

US 2019/0145122 A1 May 16, 2019

Related U.S. Application Data

(63) Continuation of application No. 15/615,322, filed on Jun. 6, 2017, now Pat. No. 10,214,936.
(Continued)

(51) Int. Cl.

| | |
|---|---|
| ***E04H 12/34*** | (2006.01) |
| ***E21B 15/00*** | (2006.01) |
| ***B66F 3/24*** | (2006.01) |
| ***B66F 3/28*** | (2006.01) |
| ***B66F 7/06*** | (2006.01) |
| ***B66F 7/08*** | (2006.01) |

(52) U.S. Cl.
CPC ..... *E04H 12/345* (2013.01); *B66F 3/24* (2013.01); *B66F 3/28* (2013.01); *B66F 7/0633* (2013.01); *B66F 7/08* (2013.01); *E21B 15/003* (2013.01)

(58) Field of Classification Search
CPC ..... E04H 12/345; B66F 7/0633; B66F 7/08; B66F 3/24; B66F 3/28; E21B 15/003; E21B 7/02
USPC ..... 52/111, 114, 117, 118, 632, 651.05
See application file for complete search history.

(56) References Cited

U.S. PATENT DOCUMENTS

| | | | |
|---|---|---|---|
| 3,228,151 | A | 1/1966 | Woolslayer et al. |
| 3,650,339 | A | 3/1972 | Selfe et al. |

(Continued)

FOREIGN PATENT DOCUMENTS

| | | | |
|---|---|---|---|
| BR | 9811431 | A | 9/1998 |
| CN | 201254949 | A | 9/2008 |

(Continued)

OTHER PUBLICATIONS

Office Action issued in Colombian App. No. NC2018/0012922 and English translation thereof, dated Apr. 1, 2020 (14 pages).

*Primary Examiner* — Joshua K Ihezie
(74) *Attorney, Agent, or Firm* — Adolph Locklar

(57) ABSTRACT

A side saddle slingshot drilling rig includes a left and right substructure including a left and right lower box. The side saddle slingshot drilling rig includes a drill rig floor mechanically and pivotably coupled to the left and right lower boxes such that it is pivotably movable from a lowered position to a raised position. The drill rig floor includes a V-door. The V-door is positioned on the V-door side of the drill rig floor. The V-door side of the drill rig floor is oriented to face the right substructure. A mast coupled to the drill rig floor may include an open side, defining a mast V-door side. The mast V-door side may be oriented to face the right substructure. The mast may pivot into its raised position or may be a bootstrap mast.

11 Claims, 13 Drawing Sheets

Related U.S. Application Data

(60) Provisional application No. 62/346,982, filed on Jun. 7, 2016.

(56) References Cited

U.S. PATENT DOCUMENTS 3,754,361 A 8/1973 Branham et al.
3,802,137 A 4/1974 Armstrong
4,375,892 A 3/1983 Jenkins et al.
4,759,414 A * 7/1988 Willis ..... E21B 15/00 173/185
4,821,816 A * 4/1989 Willis ..... E21B 15/00 175/57
4,837,992 A 6/1989 Hashimoto
6,343,892 B1 2/2002 Kristiansen
7,249,629 B2 7/2007 Cunningham et al.
7,306,055 B2 * 12/2007 Barnes ..... E21B 7/02 175/122
7,308,953 B2 * 12/2007 Barnes ..... E21B 7/02 175/122
7,357,616 B2 4/2008 Andrews et al.
8,720,128 B2 5/2014 Vogt
8,904,716 B2 * 12/2014 Donnally ..... E21B 15/00 52/117
8,936,424 B1 1/2015 Barnes et al.
9,027,287 B2 * 5/2015 Trevithick ..... E21B 15/00 52/112
9,091,126 B2 * 7/2015 Thiessen ..... E21B 15/00
9,091,128 B1 7/2015 Orgeron et al.
9,157,286 B2 10/2015 Richardson et al.
9,399,890 B2 * 7/2016 Mark ..... E21B 19/155
9,476,267 B2 10/2016 Orgeron et al.
9,708,861 B2 * 7/2017 Reddy ..... E21B 15/003
9,797,196 B2 10/2017 Taggart et al.
2001/0025727 A1 10/2001 Byrt et al.
2003/0172599 A1 * 9/2003 Frink ..... E21B 15/003 52/116
2004/0211598 A1 10/2004 Palidis
2006/0231267 A1 10/2006 Wood
2009/0000218 A1 * 1/2009 Lee ..... E21B 15/00 52/123.1
2009/0218144 A1 9/2009 Donnally et al.
2010/0329823 A1 12/2010 Baumler et al.
2011/0030942 A1 2/2011 Orgeron
2013/0343836 A1 * 12/2013 Flusche ..... B23P 11/00 414/22.55
2014/0224543 A1 * 8/2014 Padira ..... E21B 15/003 175/85
2014/0298735 A1 * 10/2014 Vogt ..... E21B 7/023 52/118
2015/0008039 A1 * 1/2015 Wijning ..... E21B 7/02 175/52
2015/0143759 A1 * 5/2015 Sparkman ..... E21B 15/00 52/123.1
2015/0218891 A1 8/2015 Reddy et al.
2016/0130877 A1 * 5/2016 Fortson ..... E21B 7/023 52/121
2016/0258178 A1 * 9/2016 Holst ..... E04H 12/187
2016/0258215 A1 9/2016 Holst
2016/0258225 A1 * 9/2016 Holst ..... E21B 15/00
2016/0298394 A1 10/2016 Reddy et al.
2016/0312543 A1 * 10/2016 Cheng ..... E21B 15/00
2017/0096832 A1 4/2017 Robb
2017/0241126 A1 8/2017 Konduc et al.
2017/0328081 A1 * 11/2017 Trevithick ..... E21B 15/00

FOREIGN PATENT DOCUMENTS

CN 101358510 A 2/2009
CO 92263646 A 5/1989
CO 04042280 A 6/2004
CO 05118908 A 4/2006
CO 07097892 A 4/2008
EP 3022381 A 1/2015
EP 3081737 T 11/2016
EP 3587728 T 1/2020
KR 101402500 A 2/2013
WO WO2009106859 A 9/2009
WO WO2012092147 A 6/2013

* cited by examiner

SIDE SADDLE SLINGSHOT DRILLING RIG

CROSS REFERENCE TO RELATED APPLICATIONS

This application is a continuation of and claims priority from U.S. non-provisional application Ser. No. 15/615,322, filed Jun. 6, 2017, which itself claims priority from U.S. provisional application No. 62/346,982, filed Jun. 7, 2016, each of which is incorporated by reference herein in its entirety.

TECHNICAL FIELD/FIELD OF THE DISCLOSURE

The present disclosure relates generally to drilling rigs, and specifically to slingshot rig structures for land drilling in the petroleum exploration and production industry.

BACKGROUND OF THE DISCLOSURE

Land-based drilling rigs may be configured to be traveled from location to location to drill multiple wells within the same area known as a wellsite. In certain situations, it is necessary to travel across an already drilled well for which there is a well-head in place. Further, mast placement on land-drilling rigs may have an effect on drilling activity. For example, depending on mast placement on the drilling rig, an existing well-head may interfere with the location of land-situated equipment such as, for instance, existing well-heads, and may also interfere with raising and lowering of equipment needed for operations.

SUMMARY

The present disclosure provides for a drilling rig. The drilling rig may include a right substructure and a left substructure. The substructures may be positioned generally parallel and spaced apart from each other. The drilling rig may also include a drill rig floor. The drill rig floor may include a V-door. The side of the drill rig floor including the V-door may define the V-door side of the drill rig floor. The V-door may be oriented to face perpendicular to the right substructure. The drilling rig may include a mast. The mast may include an open side which may define a mast V-door side. The open side may be oriented to face perpendicular to the right substructure. The mast may be pivotably coupled to the drill rig floor by one or more pivot points and one or more lower mast attachment points, the mast being pivotable in a direction parallel to the V-door side of the drill rig floor or the mast being pivotable in a direction perpendicular to the V-door side of the drill rig floor.

The present disclosure also provides for a method. The method may include providing a drilling rig. The drilling rig may include a right substructure and a left substructure. The right substructure may include a right lower box and a first strut, the first strut pivotably coupled to the drill rig floor and pivotably coupled to the right lower box. The left substructure may include a left lower box and a second strut, the second strut pivotably coupled to the drill rig floor and pivotably coupled to the left lower box. The substructures may be positioned generally parallel and spaced apart from each other. The drilling rig may include a drill rig floor. The drill rig floor may include a V-door. The side of the drill rig floor including the V-door may define the V-door side of the drill rig floor. The V-door may be oriented to face perpendicular to the right substructure. The method may include providing a mast. The mast may include an open side which may define a mast V-door side. The open side may be oriented to face perpendicular to the right substructure. The method may include mechanically coupling the mast to the drill rig floor and raising the mast into a raised position.

The present disclosure further provides for a hydraulic cylinder skid. The hydraulic cylinder skid includes a skid frame, the skid frame having a rig attachment point. The hydraulic cylinder skid also includes one or more raising cylinders, the raising cylinders pivotably coupled to the skid frame. In addition, the hydraulic cylinder skid includes a hydraulic power unit, the hydraulic power unit mechanically coupled to the skid frame and operatively coupled to the one or more raising cylinders.

The present disclosure provides for a method. The method includes providing a drilling rig. The drilling rig includes a right substructure and a left substructure, the substructures positioned generally parallel and spaced apart from each other. The right substructure includes a right lower box and a first strut, the first strut pivotably coupled to the drill rig floor and pivotably coupled to the right lower box. The left substructure includes a left lower box and a second strut, the second strut pivotably coupled to the drill rig floor and pivotably coupled to the left lower box. The drilling rig also includes a drill rig floor, the drill rig floor including a V-door. The side of the drill rig floor includes the V-door defining the V-door side of the drill rig floor. The V-door is oriented to face perpendicular to the right substructure. The method also includes providing a mast, the mast including an open side defining a mast V-door side. The open side is oriented to face perpendicular to the right substructure. The method also includes mechanically coupling the mast to the drill rig floor and positioning a hydraulic cylinder skid. The hydraulic cylinder skid includes a skid frame, the skid frame having a rig attachment point. The skid also includes one or more raising cylinders, the one or more raising cylinders pivotably coupled to the skid frame. The skid includes a hydraulic power unit, the hydraulic power unit mechanically coupled to the skid frame and operatively coupled to the one or more raising cylinders. The method includes mechanically coupling the skid frame to the drilling rig at the rig attachment point and raising the mast into a raised position using the raising cylinders.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
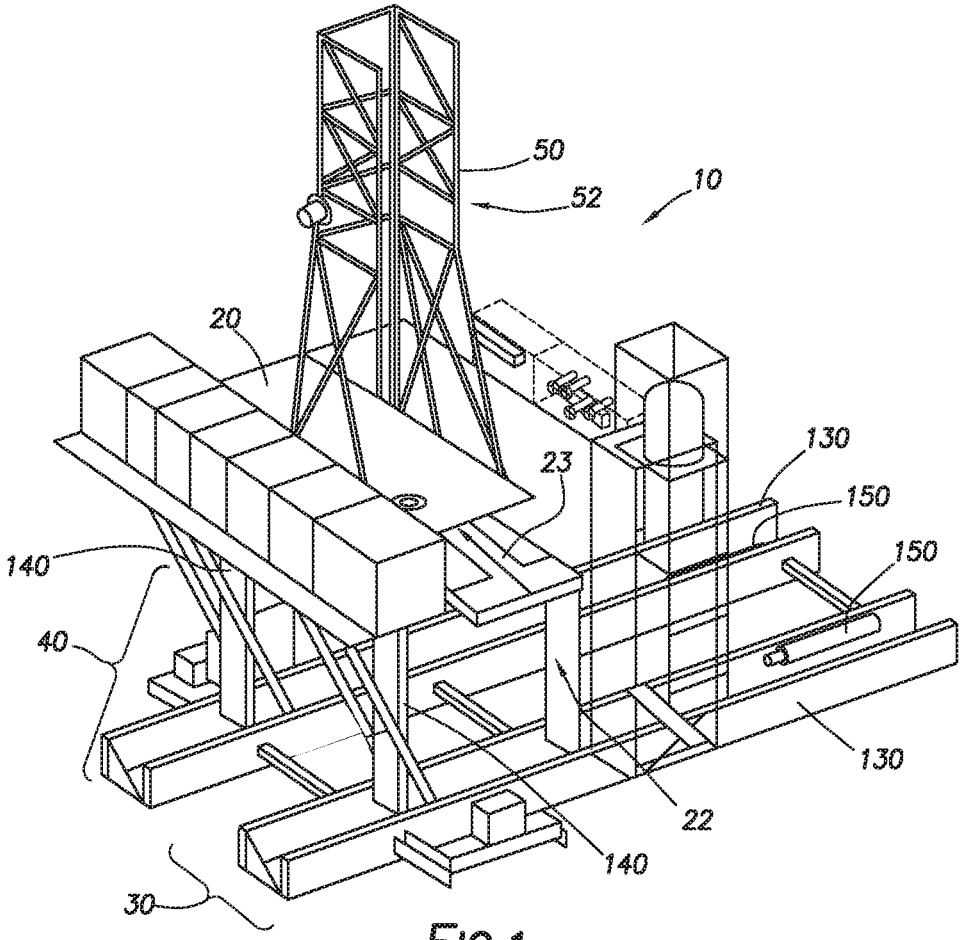
FIG. 1 depicts a perspective view of a side saddle slingshot rig consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts a perspective view of side saddle slingshot drilling rig 10 in a mast raised position. In some embodiments, side saddle slingshot drilling rig 10 may include drill rig floor 20, right substructure 30, left substructure 40, and mast 50. Right and left substructures 30, 40 may support drill rig floor 20. Right and left substructures 30, 40 may be generally parallel and spaced apart in the right-left direction. As would be understood by one having ordinary skill in the art with the benefit of this disclosure, the terms "right" and "left" as used herein are only used to refer to each separate substructure to simplify discussion, and are not intended to limit this disclosure in any way. Right and left substructures 30, 40, may each include one or more lower boxes 130 and one or more struts 140. Drill rig floor 20 may be mechanically coupled to lower boxes 130 by struts 140. Struts 140 may be pivotably coupled to drill rig floor 20 and to one or more lower boxes 130. Lower boxes 130 may be generally parallel to each other and spaced apart in the left-right direction. In some embodiments, struts 140 may be coupled to drill rig floor 20 and lower boxes 130 such that struts 140 form a bar linkage between lower boxes 130 and drill rig floor 20, allowing relative motion of drill rig floor 20 relative to lower boxes 130 while maintaining drill rig floor 20 parallel to lower boxes 130 as further discussed herein below. In some embodiments, right substructure 30 may include a lower box 130 referred to herein as a right lower box. In some embodiments, left substructure 40 may include a lower box 130 referred to herein as a left lower box.

In some embodiments, drill rig floor 20 may include V-door 23. The side of drill rig floor 20 at which V-door 23 is referred to herein as V-door side 22. In some embodiments, V-door side 22 of side saddle slingshot drilling rig 10 may face the right substructure 30. In some embodiments, V-door 23 may be oriented to face perpendicular to right substructure 30. In some embodiments, V-door side 22 may be parallel to right substructure 30.

In some embodiments, mast 50 may include mast V-door side 52, defined as the open side of mast 50. In some embodiments, mast V-door side 52 may be aligned with V-door 23. In some embodiments, mast V-door side 52 may be oriented to face perpendicular to right substructure 30. In some embodiments, mast 50 may be pivotably coupled to drill rig floor 20 by one or more pivot points 60 and one or more lower mast attachment points 62. Lower mast attachment points 62 may be disconnected, allowing mast 50 to pivot on pivot points 60 as further discussed herein below. In some such embodiments, mast 50 may thus be lowerable from the upright position depicted in FIG. 1 to a lowered position.

Figure 2:
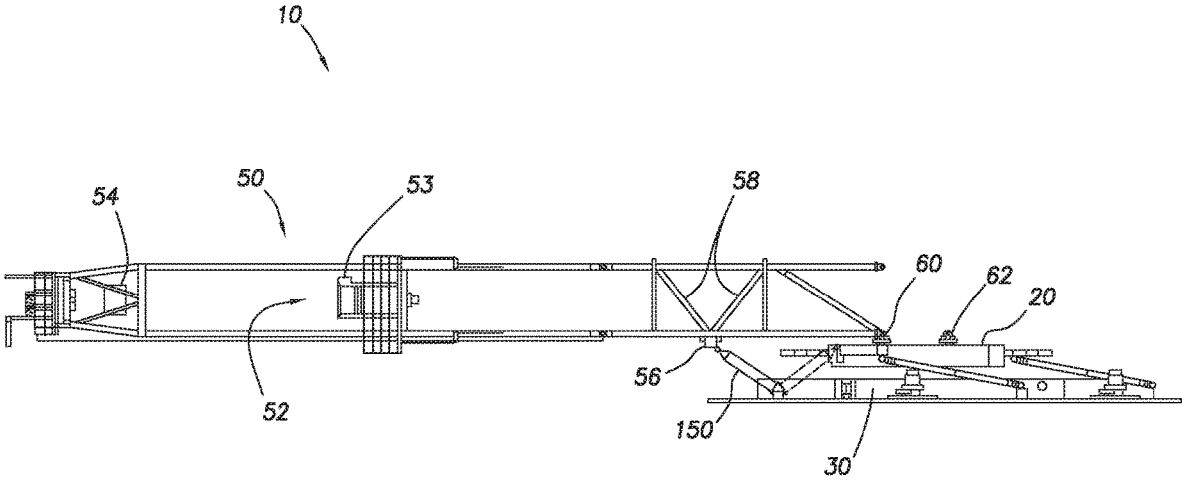
FIG. 2 depicts a side view of a side saddle slingshot rig in a lowered position consistent with at least one embodiment of the present disclosure.

FIG. 2 depicts side saddle slingshot drilling rig 10 consistent with at least one embodiment of the present disclosure. In some embodiments, mast 50 is pivotably lowerable in a direction parallel to V-door side 22 of drill rig floor 20. In such an embodiment, mast V-door side 52 may be oriented to face horizontally when mast 50 is in the lowered position. In such an embodiment, components of mast 50 including, for example and without limitation, top drive 53 and traveling block 54 may be retained within mast 50 without additional components. In some embodiments, mast 50 may be removable from drill rig floor 20 and transported horizontally.

Figure 3:
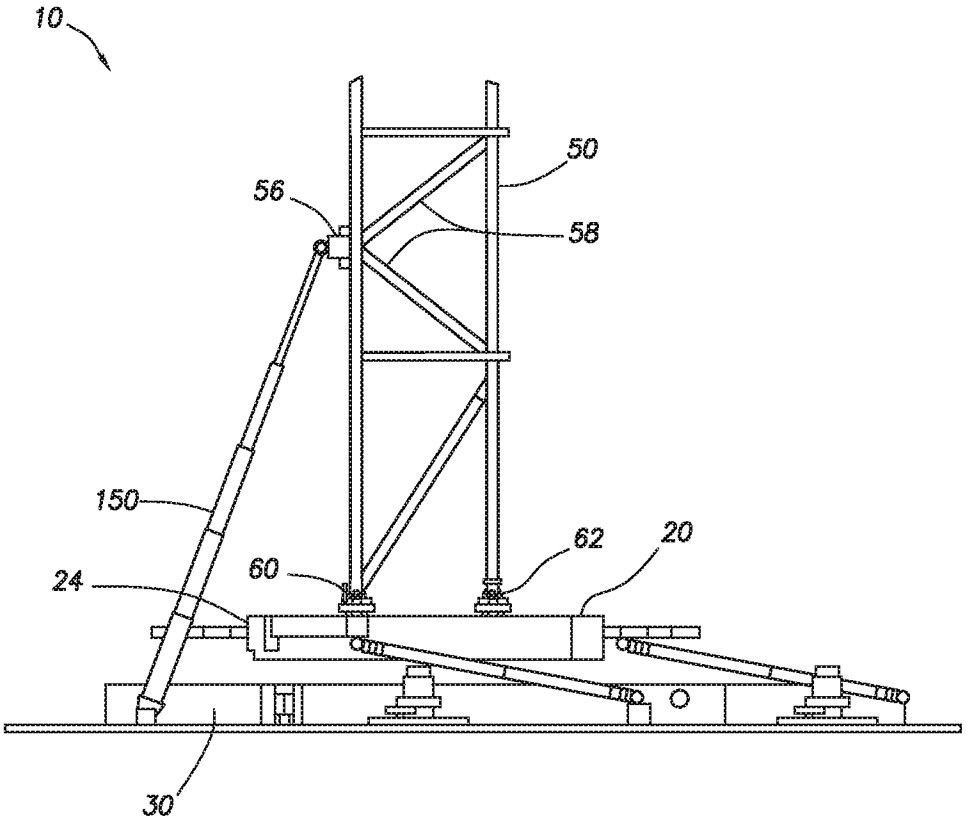
FIG. 3 depicts a side view of the side saddle slingshot rig of FIG. 2 in a mast-raised position.
Figure 4:
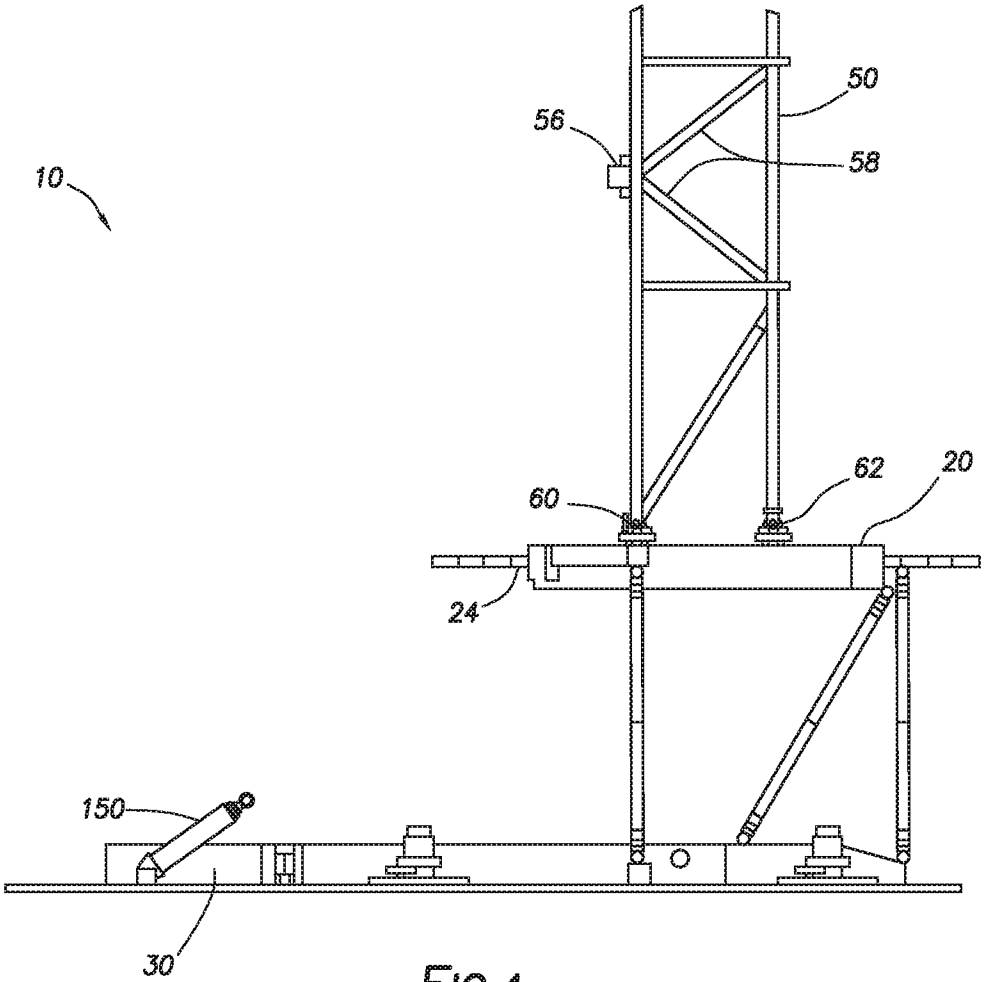
FIG. 4 depicts a side view of the side saddle slingshot rig of FIG. 2 in a raised position.
Figure 5:
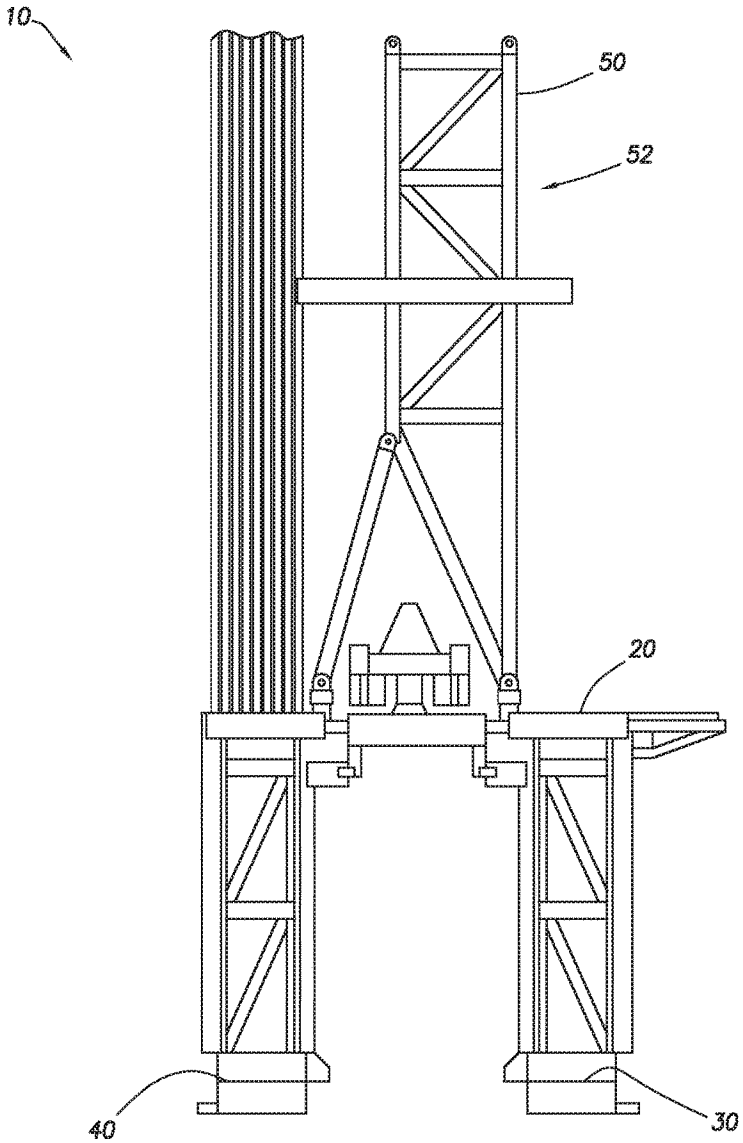
FIG. 5 depicts a side view of the side saddle slingshot rig of FIG. 2 in a raised position perpendicular to the view of FIG. 4.

In some embodiments, to move mast 50 from the lowered position to the mast raised position, mast 50 may be mechanically and pivotably coupled to drill rig floor 20 by one or more pivot points 60. One or more hydraulic cylinders 150 may be mechanically coupled to mast 50. In some embodiments, hydraulic cylinders 150 may mechanically couple to one or more corresponding upper mast attachment points 56 positioned on mast 50. In some embodiments, mast 50 may include one or more braces 58 positioned to, for example and without limitation, brace mast 50 at upper mast attachment points 56. In some embodiments, mast 50 may be moved into the mast raised position by extending hydraulic cylinders 150 such that mast 50 moves from a horizontal position to a vertical position as depicted in FIG. 3. Mast 50 may be mechanically coupled to drill rig floor 20 by one or more lower mast attachment points 62. In some embodiments, hydraulic cylinders 150 may be detached from upper mast attachment points 56 and mechanically coupled to drill rig floor lifting points 24. Hydraulic cylinders 150 may then be extended to move drill rig floor 20 from the lowered position as depicted in FIG. 3 to the raised position as depicted in FIGS. 4, 5. Hydraulic cylinders 150 may be disconnected from drill rig floor lifting points 24, retracted and stored in right and left substructures 30, 40. In some embodiments, hydraulic cylinders 150 may be utilized to transition side saddle slingshot drilling rig 10 from the raised position to the mast raised position and the lowered position by reversing the previously described operations.

Figure 6:
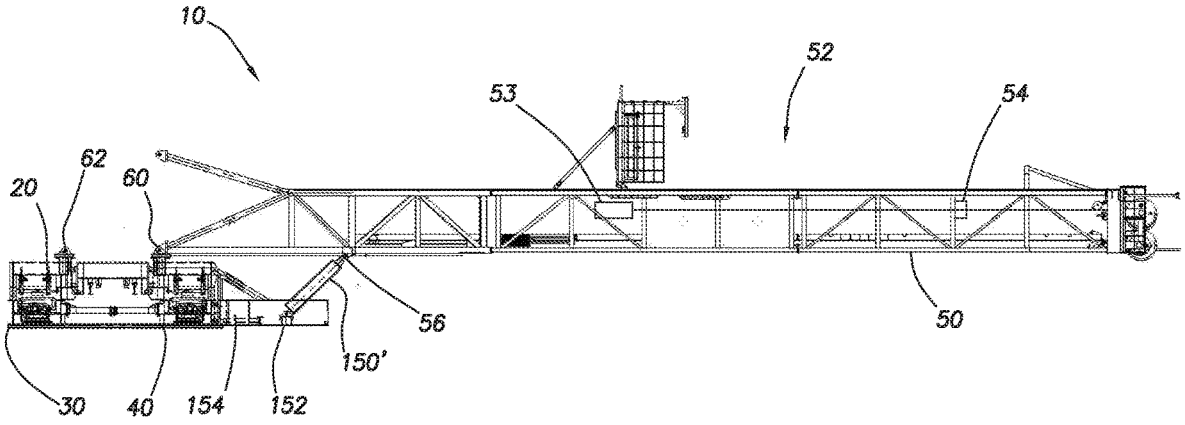
FIG. 6 depicts a side view of a side saddle slingshot rig consistent with at least one embodiment of the present disclosure in a lowered position.
Figure 7:
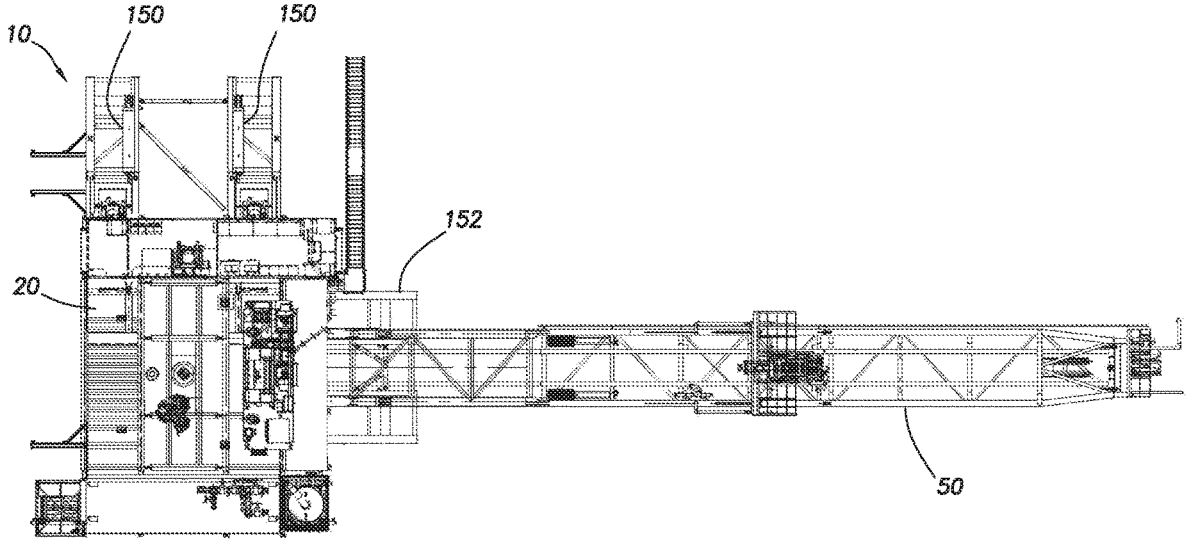
FIG. 7 depicts a top view of the side saddle slingshot rig of FIG. 6.

In some embodiments, as depicted in FIGS. 6, 7, mast 50 may be lowerable in a direction perpendicular to and away from V-door side 22 of side saddle slingshot drilling rig 10. In such an embodiment, mast V-door side 52 may be oriented to face vertically upward or vertically downward when mast 50 is in the lowered position. In such an embodiment, components of mast 50 including, for example and without limitation, top drive 53 and traveling block 54 may be retained within mast 50 without additional components. In some embodiments, mast 50 may be removable from drill rig floor 20 by disconnecting mast 50 from drill rig floor 20 at pivot points 60. In some such embodiments, mast 50 may be transported horizontally.

As shown in FIG. 6, in some embodiments, to move mast 50 from the lowered position to the mast raised position, one or more mast hydraulic cylinders 150' may be mechanically coupled to mast 50. In some embodiments, hydraulic cylinders 150 may mechanically couple to one or more corresponding upper mast attachment points 56 positioned on mast 50. In some embodiments, mast hydraulic cylinders 150' may be positioned on cylinder sub box 152. In some embodiments, cylinder sub box 152 may be coupled to left substructure 40 before mast 50 is coupled to drill rig floor 20. In some embodiments, cylinder sub box 152 may include ballast weight 154 to, for example and without limitation, restrict cylinder sub box 152 from overturning. In some embodiments, mast hydraulic cylinders 150' may be mechanically coupled to upper mast attachment points 56 positioned on mast 50. In some embodiments, mast 50 may be moved into the mast raised position by extending mast hydraulic cylinders 150' such that mast 50 moves from a horizontal position to a vertical position. Mast 50 may be mechanically coupled to drill rig floor 20 by one or more lower mast attachment points 62 as previously described. In some embodiments, mast hydraulic cylinders 150' may be detached from upper mast attachment points 56. Hydraulic cylinders 150 may then be utilized to raise drill rig floor 20 as previously described.

Figure 8:
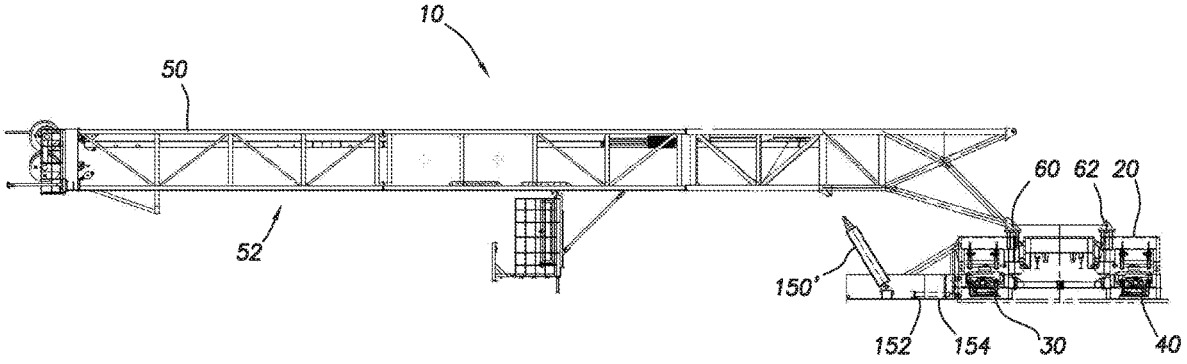
FIG. 8 depicts a side view of a side saddle slingshot rig consistent with at least one embodiment of the present disclosure.
Figure 9:
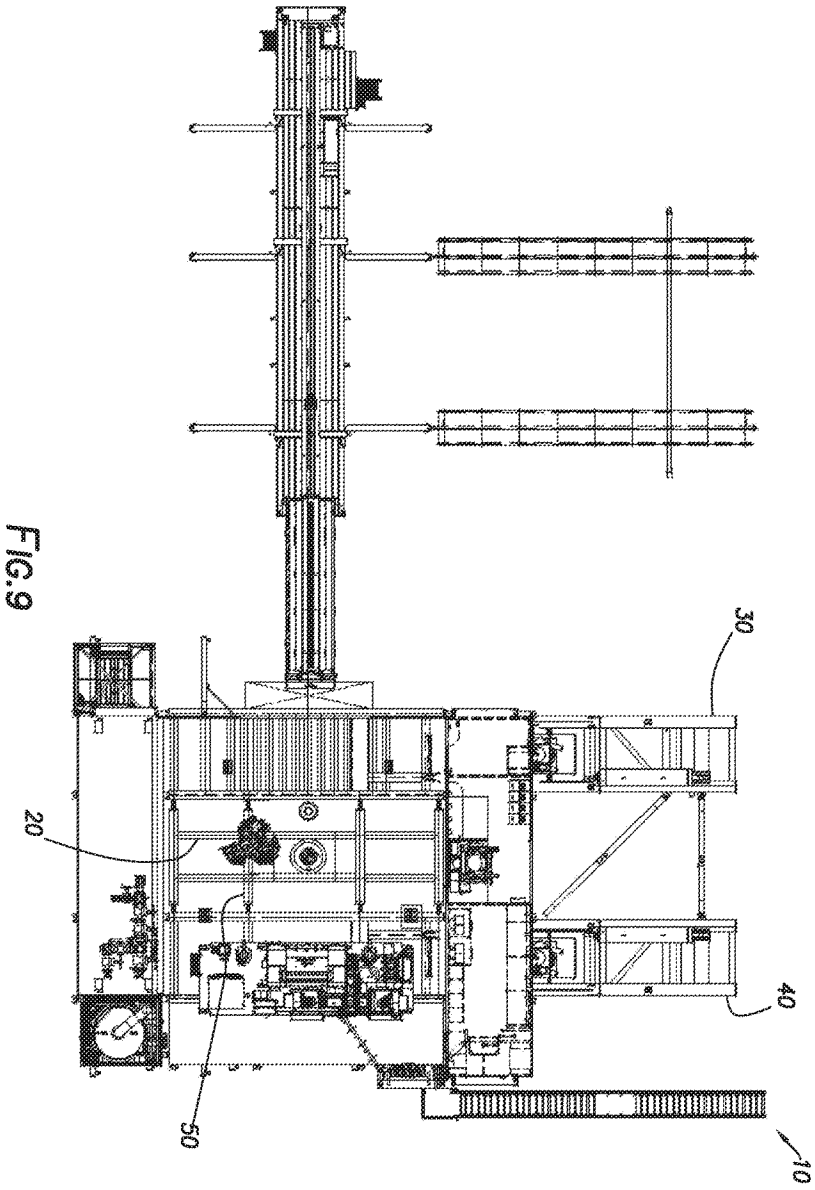
FIG. 9 depicts a top view of the side saddle slingshot rig of FIG. 8 in the raised position.

In some embodiments, as depicted in FIGS. 8, 9, mast 50 may be lowerable in a direction perpendicular to and toward V-door side 22 of side saddle slingshot drilling rig 10. In such an embodiment, mast V-door side 52 may be oriented to face vertically downward when mast 50 is in the lowered position. In some embodiments, mast 50 may be removable from drill rig floor 20 by disconnecting mast 50 from drill rig floor 20 at pivot points 60. In some such embodiments, mast 50 may be transported horizontally.

In some embodiments, to move mast 50 from the lowered position to the mast raised position, one or more mast hydraulic cylinders 150' may be coupled to mast 50. In some embodiments, mast hydraulic cylinders 150' may be positioned on cylinder sub box 152. In some embodiments, cylinder sub box 152 may be mechanically coupled to right substructure 30. In some embodiments, cylinder sub box 152 may include ballast weight 154 to, for example and without limitation, restrict cylinder sub box 152 from overturning. In some embodiments, mast hydraulic cylinders 150' may be mechanically coupled to upper mast attachment points 56 positioned on mast 50. In some embodiments, mast 50 may be moved into the mast raised position as depicted in FIG. 9 by extending mast hydraulic cylinders 150' such that mast 50 moves from a horizontal position to a vertical position. Mast 50 may be mechanically coupled to drill rig floor 20 by one or more lower mast attachment points 62 as previously described. In some embodiments, mast hydraulic cylinders 150' may be detached from upper mast attachment points 56. Hydraulic cylinders 150 may then be utilized to raise drill rig floor 20 as previously described.

Figure 10:
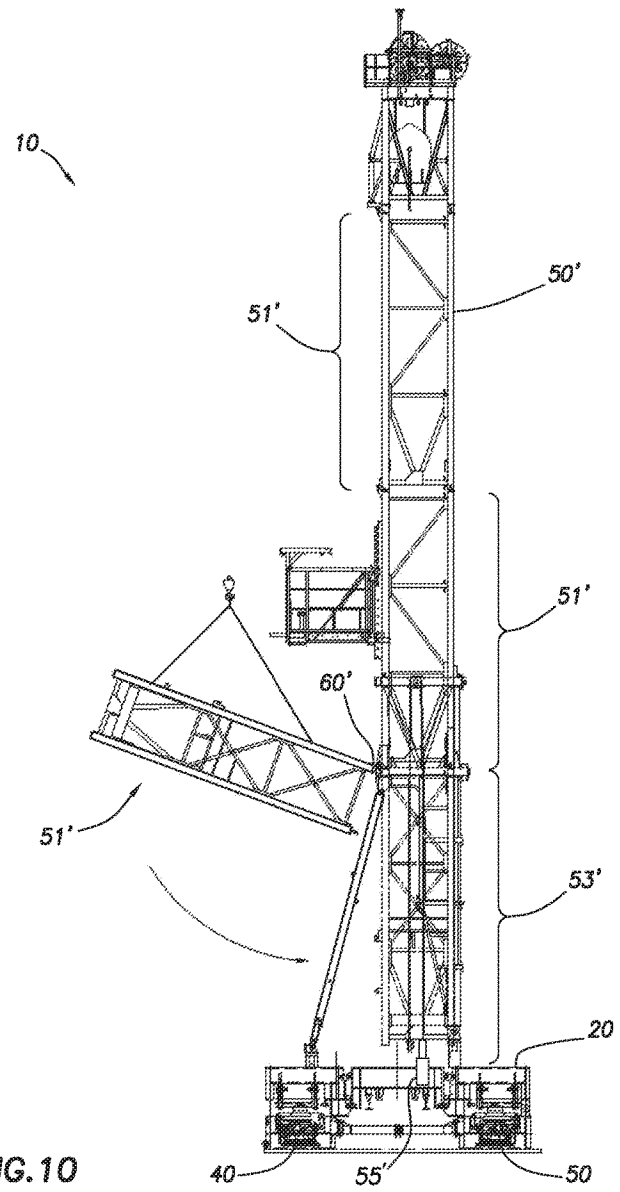
FIG. 10 depicts a side view of a side saddle bootstrap rig consistent with at least one embodiment of the present disclosure.

In some embodiments, mast 50' as depicted in FIG. 10 may be a bootstrap style mast. In such an embodiment, mast 50' may include one or more mast subcomponents 51'. Each mast subcomponent 51' may include an open side defining mast V-door side 52 of mast 50'. In some embodiments, mast V-door side 52 may be oriented to face perpendicular to right substructure 30. Mast subcomponents 51' may be sequentially hoisted onto drill rig floor 20. In some embodiments, mast subcomponents 51' may be placed within mast lower subcomponent 53' and may be hoisted vertically upward within mast lower subcomponent 53'. In some embodiments, a subsequent mast subcomponent 51' may be inserted within mast lower subcomponent 53' through mast V-door side 52 of mast lower subcomponent 53', mechanically coupled to the previously hoisted mast subcomponent or subcomponents 51', and hoisted. In some embodiments, a drawworks may be utilized to hoist the mast subcomponents 51'. In some embodiments, one or more hydraulic cylinders 55' may be utilized to hoist the mast subcomponents 51'. In certain embodiments, once mast 50' is a desired height, the mechanically coupled mast subcomponents 51' may be mechanically coupled to mast lower subcomponent 53'. Mast lower subcomponent 53' may be mechanically coupled to drill rig floor 20. Mast subcomponents 51' may be mechanically coupled at pivot point 60' to, for example and without limitation, allow the mast subcomponents 51' to pivot into mast lower subcomponent 53'.

Figure 11:
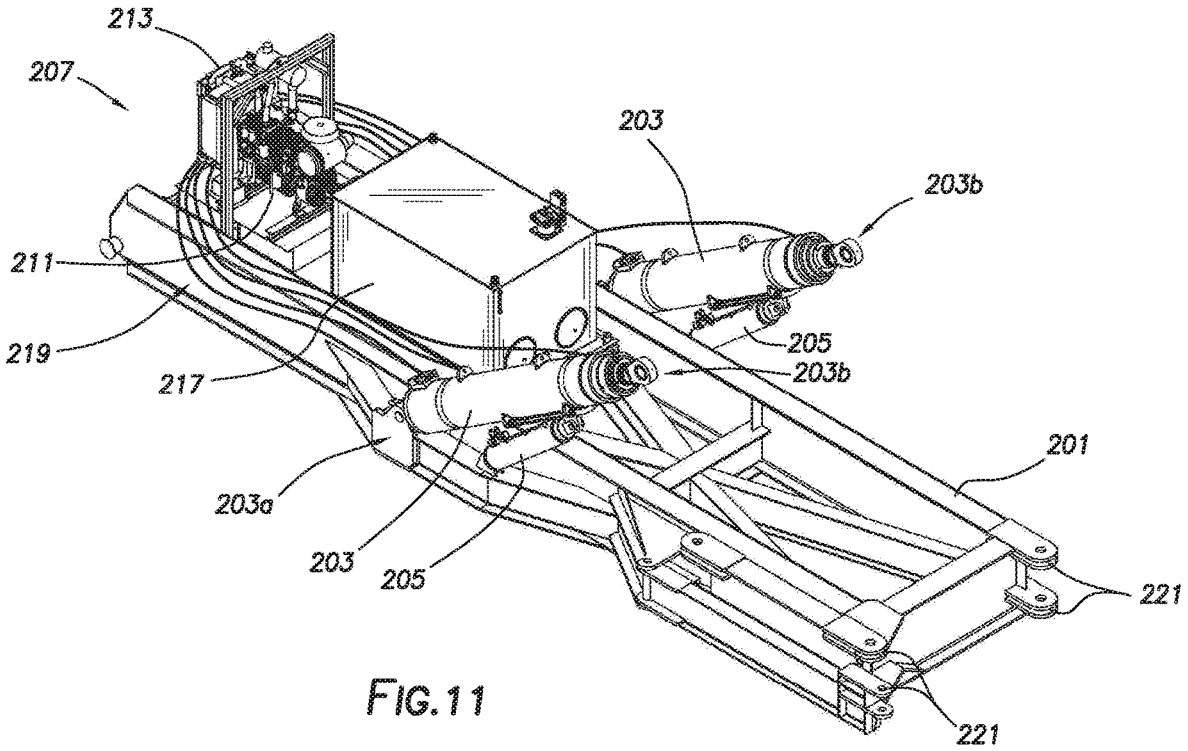
FIG. 11 depicts a hydraulic cylinder skid consistent with at least one embodiment of the present disclosure.
Figure 12:
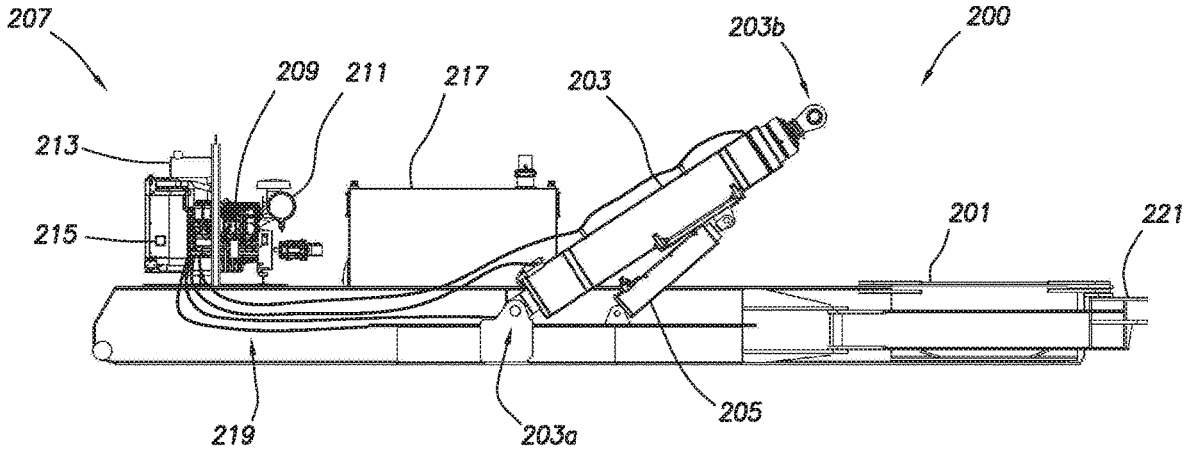
FIG. 12 is a side view of the hydraulic cylinder skid of FIG. 11.

FIGS. 11 and 12 depict hydraulic cylinder skid 200. Hydraulic cylinder skid 200 may include skid frame 201. Skid frame 201 may support other components of hydraulic cylinder skid 200 and allow for transportation of hydraulic cylinder skid 200 as a single unit. In some embodiments, hydraulic cylinder skid 200 may include one or more raising cylinders 203. Raising cylinders 203 may be pivotably coupled to skid frame 201 at lower end 203*a* of raising cylinders 203. In some embodiments, hydraulic cylinder skid 200 may include cylinder positioning hydraulic cylinders 205. Each cylinder positioning hydraulic cylinder 205 may mechanically couple between skid frame 201 and a respective raising cylinder 203. Extension or retraction of cylinder positioning hydraulic cylinders 205 may allow the angle at which raising cylinders 203 extend from hydraulic cylinder skid 200 to be controlled. By modulating the extension of raising cylinders 203 and cylinder positioning hydraulic cylinders 205, upper end 203*b* of raising cylinders 203 may be positioned in space to, for example and without limitation, align with drill rig floor lifting points 24, upper mast attachment points 56 or any other desired position as described further herein below.

In some embodiments, hydraulic cylinder skid 200 may include hydraulic power unit 207. Hydraulic power unit 207 may be mechanically coupled to skid frame 201. Hydraulic power unit 207 may generate hydraulic pressure that may be used, for example and without limitation, to extend or retract raising cylinders 203 and cylinder positioning hydraulic cylinders 205. In some embodiments, hydraulic power unit 207 may include hydraulic pump 209. Hydraulic pump 209 may be used to pressurize hydraulic fluid. In some embodiments, hydraulic pump 209 may be powered mechanically by pump engine 211. Pump engine 211 may be, for example and without limitation, a combustion engine or electric motor.

In some embodiments, hydraulic power unit 207 may operatively couple to raising cylinders 203 and cylinder positioning hydraulic cylinders 205 through hydraulic cylinder skid controls 213. Hydraulic cylinder skid controls 213 may include one or more manifolds and valves positioned to control the flow of hydraulic fluid to raising cylinders 203 and cylinder positioning hydraulic cylinders 205 in order to control the extension or retraction of raising cylinders 203 and cylinder positioning hydraulic cylinders 205. In some embodiments, hydraulic cylinder skid controls 213 may be manually operated. In some embodiments, hydraulic cylinder skid controls 213 may be at least partially automated. In such an embodiment, hydraulic cylinder skid controls 213 may include programmable logic controller (PLC) 215 adapted to control the operation of raising cylinders 203 and cylinder positioning hydraulic cylinders 205.

In some embodiments, hydraulic cylinder skid 200 may include other components of a hydraulic system including, for example and without limitation, hydraulic reservoir 217 and hydraulic lines 219. In some embodiments, by including all components of a hydraulic system, hydraulic cylinder skid 200 may be transportable and usable without the need to disassemble or reassembly components of hydraulic cylinder skid 200.

In some embodiments, skid frame 201 may include rig attachment points 221. Rig attachment points 221 may be adapted to allow skid frame 201 to be mechanically coupled to a drilling rig in order to use raising cylinders 203 to interact with components of the drilling rig as discussed further below. Rig attachment points 221 may include, for example and without limitation, one or more holes that correspond to holes formed on the drilling rig to allow a pin-connection to be made to temporarily mechanically couple hydraulic cylinder skid 200 to the drilling rig.

Figure 13:
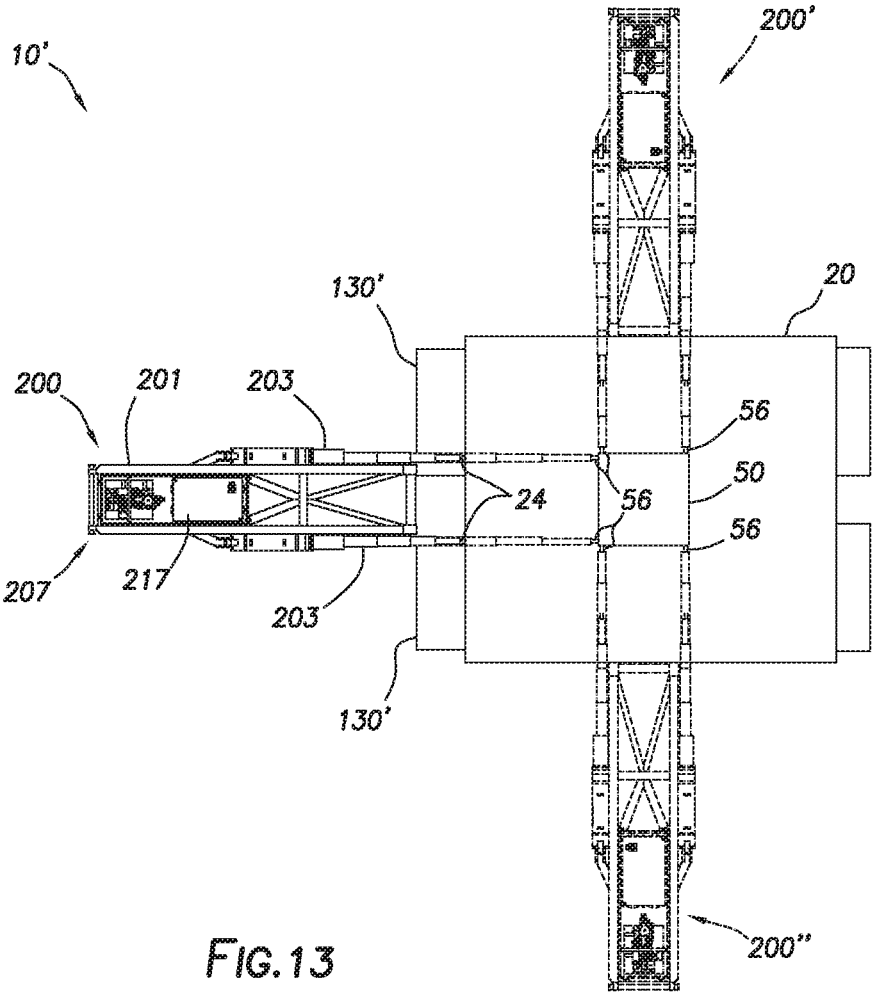
FIG. 13 depicts a top view of the side saddle slingshot rig with an attached hydraulic cylinder skid consistent with at least one embodiment of the present disclosure.

For example, FIG. 13 depicts hydraulic cylinder skid 200 mechanically coupled to side saddle slingshot drilling rig 10'. In some embodiments, hydraulic cylinder skid 200 may be mechanically coupled to side saddle slingshot drilling rig 10' at an end of lower boxes 130' corresponding with the direction in which drill rig floor 20 moves when moved to the lowered position as discussed herein above. In some embodiments rig attachment points 221 may mechanically couple to corresponding attachment points formed on one or both of lower boxes 130'. In some embodiments, hydraulic cylinder skid 200 may be used to move drill rig floor 20 between the raised and the lowered position using raising cylinders 203 substantially as described with respect to hydraulic cylinders 150 as described herein above. For example, in some embodiments, upper end 203*b* of raising cylinders 203 may mechanically couple to one or more corresponding drill rig floor lifting points 24 of drill rig floor 20. Raising cylinders 203 may then be extended to move drill rig floor 20 from the lowered position to the raised position, or may be retracted to move drill rig floor 20 from the raised position to the lowered position. Once drill rig floor is in the desired position, raising cylinders 203 may be decoupled from drill rig floor lifting points 24.

In some embodiments in which mast 50 is lowerable in a direction parallel to V-door side 22 of side saddle slingshot drilling rig 10', hydraulic cylinder skid 200 may be used to move mast 50 between the raised and lowered positions while mechanically coupled to side saddle slingshot drilling rig 10' at an end of lower boxes 130'. In such an embodiment, upper end 203*b* of raising cylinders 203 may mechanically couple to one or more corresponding upper mast attachment points 56 of mast 50. Raising cylinders 203 may then be extended to move mast 50 from the lowered position to the raised position, or may be retracted to move mast 50 from the raised position to the lowered position. Once mast 50 is in the desired position, raising cylinders 203 may be decoupled from upper mast attachment points 56.

In embodiments in which mast 50 is lowerable in a direction perpendicular to V-door side 22 of side saddle slingshot drilling rig 10', hydraulic cylinder skid 200 may be used to raise drill rig floor 20 as described above mechanically coupled to side saddle slingshot drilling rig 10' at an end of lower boxes 130'. In order to raise mast 50 from the lowered position to the raised position, hydraulic cylinder skid 200 may be mechanically coupled to side saddle slingshot drilling rig 10' at a side of one of lower boxes 130' depending on the direction in which mast 50 is lowered, denoted in FIG. 13 as hydraulic cylinder skid 200' and 200". In such an embodiment, with hydraulic cylinder skid 200' or 200" mechanically coupled to the side of one of lower boxes 130', In such an embodiment, upper end 203*b* of raising cylinders 203 may mechanically couple to one or more corresponding upper mast attachment points 56 of mast 50. Raising cylinders 203 may then be extended to move mast 50 from the lowered position to the raised position, or may be retracted to move mast 50 from the raised position to the lowered position. Once mast 50 is in the desired position, raising cylinders 203 may be decoupled from upper mast attachment points 56, and hydraulic cylinder skid 200' or 200" may be mechanically decoupled from the respective lower box 130', moved to the position at the end of lower boxes 130' denoted hydraulic cylinder skid 200, and may be used to raise or lower drill rig floor 20 as discussed above.

One having ordinary skill in the art with the benefit of this disclosure will understand that the present disclosure does not limit the order of raising or lowering of mast 50 and drill rig floor 20.

Once drill rig floor 20 and mast 50 are in the desired raised or lowered positions, upper end 203*b* of raising cylinders 203 may be mechanically decoupled from drill rig floor lifting points 24 and upper mast attachment points 56, raising cylinders 203 may be fully retracted for storage, and hydraulic cylinder skid 200 may be mechanically decoupled from side saddle slingshot drilling rig 10'. During operation or transportation of side saddle slingshot drilling rig 10', hydraulic cylinder skid 200 needs not remain mechanically coupled to side saddle slingshot drilling rig 10'. In some embodiments, hydraulic cylinder skid 200 may be removed from side saddle slingshot drilling rig 10' to, for example and without limitation, reduce the weight of, footprint of, and number of components carried by side saddle slingshot drilling rig 10' during operation or transportation of side saddle slingshot drilling rig 10'. In some embodiments, hydraulic cylinder skid 200 may be transported to a second drilling rig on the same or another wellsite to raise or lower the respective drill floor or mast of the second drilling rig.

In some embodiments, because hydraulic cylinder skid 200 includes raising cylinders 203, cylinder positioning hydraulic cylinders 205, hydraulic power unit 207, hydraulic pump 209, pump engine 211, hydraulic cylinder skid controls 213, hydraulic reservoir 217, and hydraulic lines 219 all mechanically coupled to skid frame 201, hydraulic cylinder skid 200 may be transported as a single unit without the need to disconnect any operative couplings between the components of hydraulic cylinder skid 200. In some embodiments, such as where pump engine 211 is a combustion engine, hydraulic cylinder skid 200 may operate independently without any additional connections to external equipment required.

Although described with respect to side saddle slingshot drilling rig 10' as described herein, one having ordinary skill in the art with the benefit of this disclosure will understand that hydraulic cylinder skid 200 may be used with any drilling rig with a pivoting drilling floor, pivoting mast, or both Certain embodiments of the disclosure are directed to a drilling rig. The drilling rig may include a right and a left lower box. The lower boxes may be positioned generally parallel and spaced apart from each other. The drilling rig may include a drill rig floor mechanically coupled to the right lower box by a first strut. The right lower box and first strut may define a right substructure. The drill rig floor may be mechanically coupled to the left lower box by a second strut. The left lower box and second strut may define a left substructure. The struts may be pivotably coupled to the drill rig floor and pivotably coupled to the corresponding lower box. The drill rig floor may include a V-door. The side of the drill rig floor including the V-door may define the V-door side of the drill rig floor. The V-door may be oriented to face perpendicular to the right substructure. The drilling rig may include a mast. The mast may be pivotably coupled to the drill rig floor by one or more pivot points and one or more mast attachment points. The mast may include an open side defining a mast V-door side. The open side may be oriented to face perpendicular to the right substructure.

Certain embodiments of the disclosure are directed to a drilling rig. The drilling rig may include a right and a left lower box. The lower boxes may be positioned generally parallel and spaced apart from each other. The drilling rig may include a drill rig floor mechanically coupled to the right lower box by a first strut. The right lower box and first strut may define a right substructure. The drill rig floor may be mechanically coupled to the left lower box by a second strut. The left lower box and second strut may define a left substructure. The struts may be pivotably coupled to the drill rig floor and pivotably coupled to the corresponding lower box. The drill rig floor may include a V-door. The side of the drill rig floor including the V-door may define the V-door side of the drill rig floor. The V-door may be oriented to face perpendicular to the right substructure. The drilling rig may include a mast. The mast may include one or more mast subcomponents. The mast subcomponents may be mechanically coupled together and to the drill rig floor. The mast may include an open side defining a mast V-door side. The open side may be oriented to face perpendicular to the right substructure.

Certain embodiments of the disclosure are directed to a method. The method may include providing a drilling rig. The drilling rig may include a right and a left lower box. The lower boxes may be positioned generally parallel and spaced apart from each other. The drilling rig may include a drill rig floor mechanically coupled to the right lower box by a first strut. The right lower box and first strut may define a right substructure. The drill rig floor may be mechanically coupled to the left lower box by a second strut. The left lower box and second strut may define a left substructure. The struts may be pivotably coupled to the drill rig floor and pivotably coupled to the corresponding lower box. The drill rig floor may include a V-door. The side of the drill rig floor including the V-door may define the V-door side of the drill rig floor. The V-door may be oriented to face perpendicular to the right substructure. The drill rig floor may include one or more pivot points. The method may include providing a mast. The mast may include an open side defining a mast V-door side. The open side may be oriented to face perpendicular to the right substructure. The method may include mechanically coupling the mast to the one or more pivot points, mechanically coupling one or more hydraulic cylinders to the mast, and raising the mast into a raised position.

Certain embodiments of the disclosure are directed to a method. The method may include providing a drilling rig. The drilling rig may include a right and a left lower box. The lower boxes may be positioned generally parallel and spaced apart from each other. The drilling rig may include a drill rig floor mechanically coupled to the right lower box by a first strut. The right lower box and first strut may define a right substructure. The drill rig floor may be mechanically coupled to the left lower box by a second strut. The left lower box and second strut may define a left substructure. The struts may be pivotably coupled to the drill rig floor and pivotably coupled to the corresponding lower box. The drill rig floor may include a V-door. The side of the drill rig floor including the V-door may define the V-door side of the drill rig floor. The V-door may be oriented to face perpendicular to the right substructure. The method may include providing a lower mast subcomponent. The lower mast subcomponent may include an open side defining a V-door side of the lower mast subcomponent. The V-door side of the lower mast subcomponent may be oriented to face perpendicular to the right substructure. The method may further comprise mechanically coupling the lower mast subcomponent to the drill rig floor. The method may further comprise providing a mast subcomponent, positioning the mast subcomponent within the lower mast subcomponent, hoisting the mast subcomponent, and mechanically coupling the mast subcomponent to the lower mast subcomponent.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A method comprising:

providing a drilling rig, the drilling rig including:

a right substructure and a left substructure, the substructures positioned generally parallel and spaced apart from each other;

the right substructure including a right lower box and a first strut, the first strut pivotably coupled to a drill rig floor and pivotably coupled to the right lower box, the drill rig floor including a V-door, the side of the drill rig floor including the V-door defining the V-door side of the drill rig floor, the V-door oriented to face perpendicular to the right substructure;

the left substructure including a left lower box and a second strut, the second strut pivotably coupled to the drill rig floor and pivotably coupled to the left lower box;

providing a mast, the mast including an open side defining a mast V-door side, the open side oriented to face perpendicular to the right substructure;

mechanically coupling the mast to the drill rig floor;

positioning a hydraulic cylinder skid, the hydraulic cylinder skid comprising:

a skid frame, the skid frame having a rig attachment point;

one or more raising cylinders, the one or more raising cylinders pivotably coupled to the skid frame; and a hydraulic power unit, the hydraulic power unit mechanically coupled to the skid frame and operatively coupled to the one or more raising cylinders;

mechanically coupling the skid frame to the drilling rig at the rig attachment point; and raising the mast into a raised position using the raising cylinders.

2. The method of claim 1, wherein the skid frame is coupled to the drilling rig at an end of the right lower box, the left lower box, or both.

3. The method of claim 1, wherein the skid frame is coupled to the drilling rig at a side of the right lower box or the left lower box.

4. The method of claim 1, wherein the hydraulic cylinder skid further comprises at least one cylinder positioning hydraulic cylinder, the step of raising the mast comprising:

controlling the angle between the skid frame and each raising cylinder using the cylinder positioning hydraulic cylinder.

5. The method of claim 4, wherein the mast is pivotably coupled to the drill rig floor by one or more pivot points and one or more lower mast attachment points, the mast being pivotable in a direction parallel to the V-door side of the drill rig floor or the mast being pivotable in a direction perpendicular to the V-door side of the drill rig floor.

6. The method of claim 5, wherein the mast further comprises one or more upper mast attachment points, the step of raising the mast further comprising:

aligning the one or more raising cylinders with the one or more upper mast attachment points;

coupling the one or more raising cylinders with the one or more upper mast attachment points; and extending the one or more raising cylinders.

7. The method of claim 5 further comprising lowering the mast, the step of lowering the mast further comprising:

retracting the one or more raising cylinders; and decoupling the one or more raising cylinders from the one or more upper mast attachment points.

8. The method of claim 4, wherein the drill floor includes one or more drill rig floor lifting points.

9. The method of claim 8 further comprising raising the drill floor, the step of raising the drill floor comprising:

aligning the one or more raising cylinders with the one or more drill rig floor lifting points;

coupling the one or more raising cylinders with the one or more drill rig floor lifting points; and extending the one or more raising cylinders.

10. The method of claim 8 further comprising lowering the drill floor, the step of lowering the drill floor comprising:

retracting the one or more raising cylinders; and decoupling the one or more raising cylinders from the drill rig floor lifting points.

11. The method of claim 2 further comprising decoupling the skid frame from the drilling rig.

* * * * *